United States Patent [19]

Yamauchi et al.

[11] 3,998,044

[45] Dec. 21, 1976

[54] ELECTRONIC TIMEPIECE

[75] Inventors: Masamichi Yamauchi, Ichikawa; Yasuaki Nakayama, Higashikurume; Mitsuo Oooka, Tokorozawa; Hiroharu Ohtsuka, Tokyo, all of Japan

[73] Assignee: Citizen Watch Co. Ltd., Tokyo, Japan

[22] Filed: Dec. 18, 1974

[21] Appl. No.: 534,067

[30] Foreign Application Priority Data

| | | |
|---|---|---|
| Dec. 19, 1973 | Japan | 48-142653 |
| Dec. 19, 1973 | Japan | 48-142654 |
| Dec. 20, 1973 | Japan | 48-141798 |
| Jan. 23, 1974 | Japan | 49-9922 |
| Mar. 4, 1974 | Japan | 49-24929 |
| Mar. 22, 1974 | Japan | 49-31503 |
| Mar. 25, 1974 | Japan | 49-33228 |
| Apr. 9, 1974 | Japan | 49-40150 |
| July 1, 1974 | Japan | 49-75124 |
| Dec. 19, 1973 | Japan | 48-14592[U] |
| Feb. 23, 1974 | Japan | 49-21927[U] |
| Mar. 12, 1974 | Japan | 49-29034[U] |
| Apr. 24, 1974 | Japan | 49-46624[U] |
| May 21, 1974 | Japan | 49-57768[U] |

[52] U.S. Cl. ..... 58/23 R; 58/85.5

[51] Int. Cl.[2] ..... G04C 3/00

[58] Field of Search ..... 58/23 R, 50 R, 85.5; 73/6; 324/76 R, 34 R

[56] References Cited

UNITED STATES PATENTS

| | | | |
|---|---|---|---|
| 3,707,071 | 12/1972 | Walton | 58/50 R |
| 3,787,715 | 1/1974 | Eaton | 58/23 X |
| 3,789,599 | 2/1974 | Dome | 58/23 R |
| 3,802,180 | 4/1974 | Boudry | 58/23 R |
| 3,812,669 | 5/1974 | Wiget | 58/23 R |
| 3,812,670 | 5/1974 | Nikaido et al. | 58/23 D X |

*Primary Examiner*—Ulysses Weldon
*Attorney, Agent, or Firm*—Sherman & Shalloway

[57] ABSTRACT

An electronic timepiece whose minimum dislay changing time interval is relatively long and is on the order of five seconds to two minutes such, as for example, an hour minute display liquid crystal timepiece or a two hand display crystal timepiece. This timpeiece is capable of measuring a time interval between changeable displays so as to calculate a pitch or stepping rate thereof by means of a display means. A driving circuit for driving the display means is supplied with a detecting repetition pulse having a pulse of a width such that the display means is not responsive to such a degree that naked eyes can follow the display.

The detecting repetition pulse is delivered from a detecting signal generation circuit which is supplied with an output from an intermediate stage of a frequency division circuit. Measurements are provided for: (1) preventing a magnetic field generated from a driving coil of a step motor from being delivered into the movement; (2) predominantly passing the detecting repetition pulse when the detecting repetition pulse is superimposed on a driving pulse; (3) adjusting the pulse width of the driving signal; (4) moving hands of the dislay means by means of alternate pulses; (5) changing over an interval of the driving pulse from a shorter interval to a longer interval; (6) setting and aligning a minute hand by means of a winding crown; (7) adjustably fitting hands to a hand shaft; (8) holding a minute drive control circuit in phase with the step motor, and; (9) displaying a second return to zero operation which defines the minute hand.

19 Claims, 10 Drawing Figures

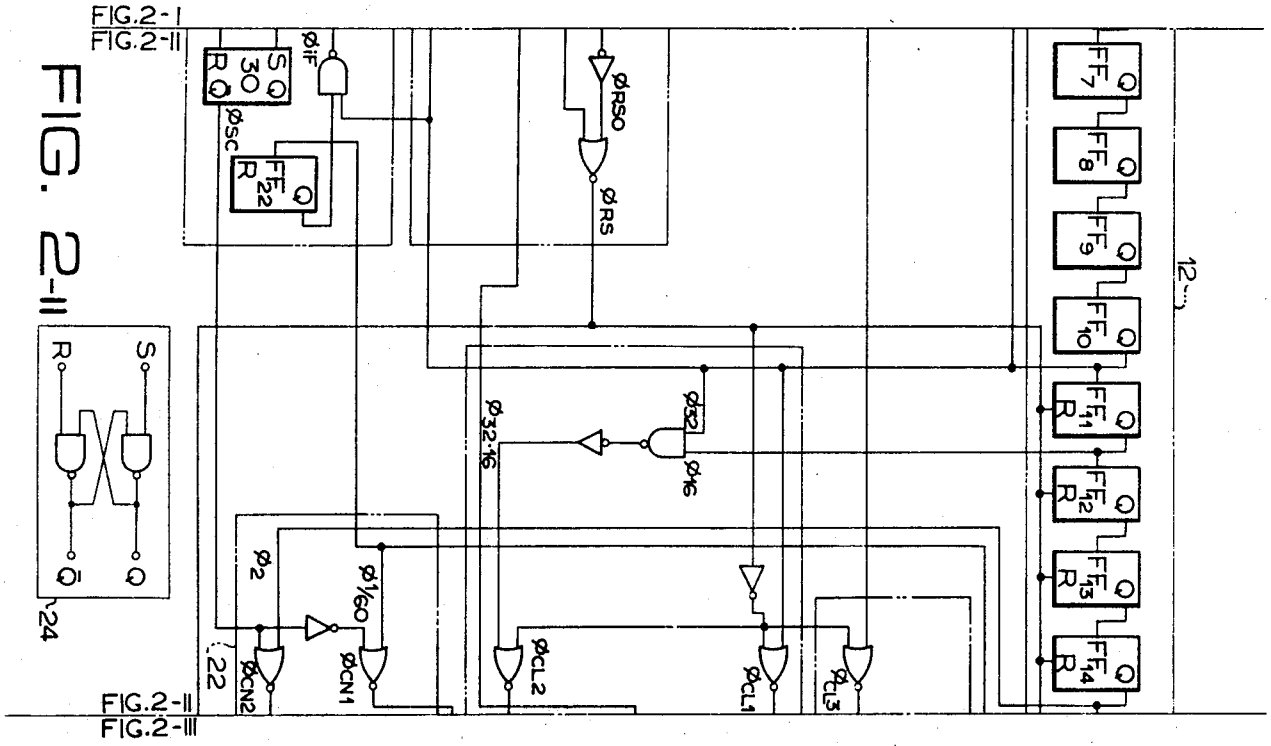
FIG. 2-II

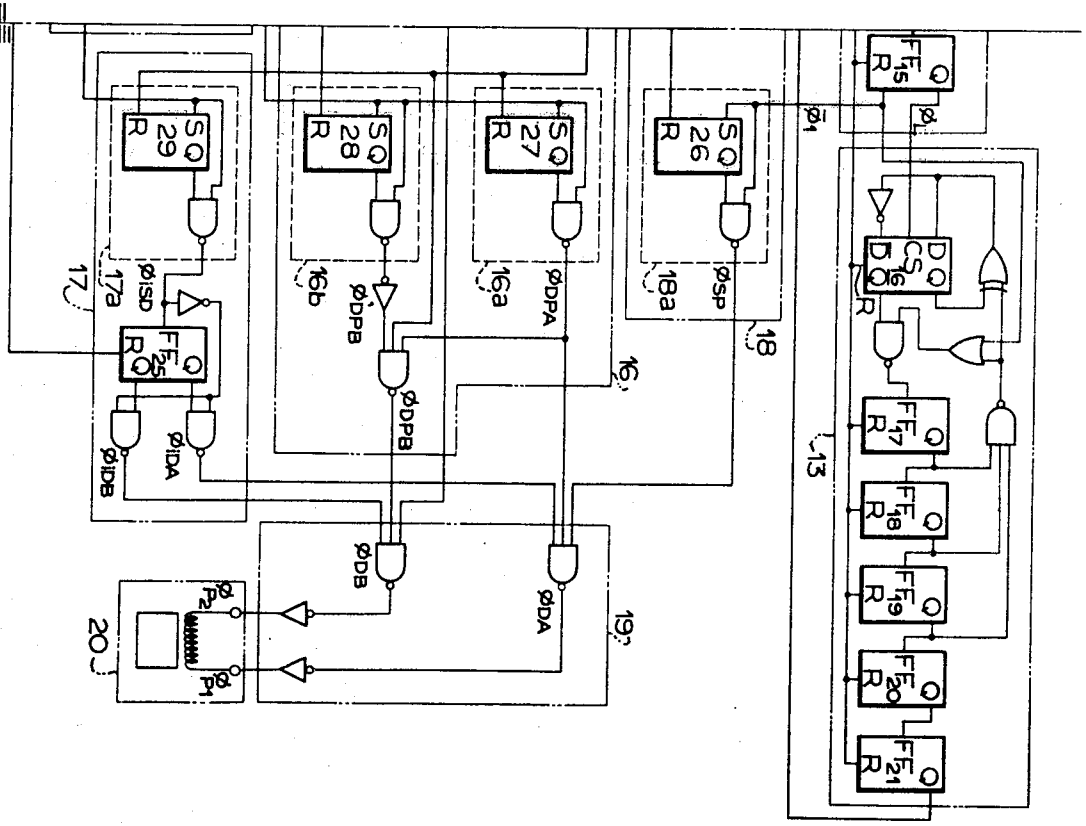
FIG. 2-III
FIG. 2-II
FIG. 2-III

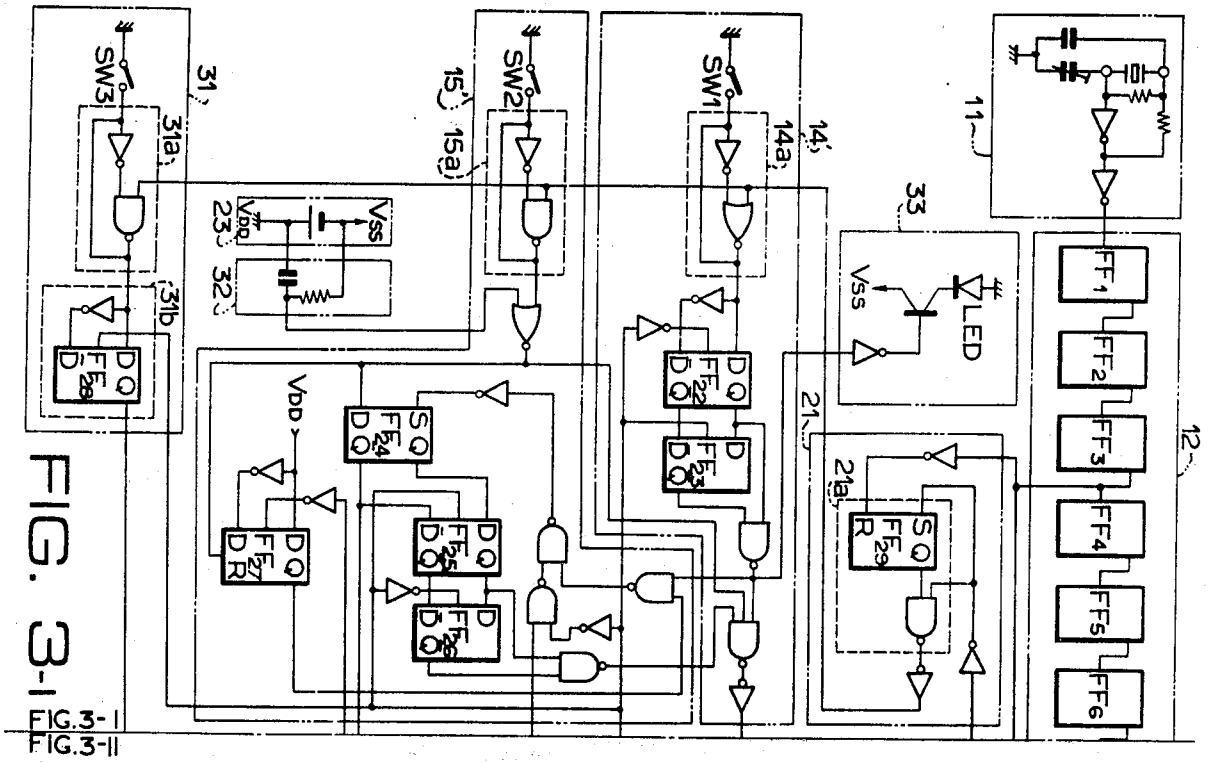
FIG. 3-I
FIG. 3-I
FIG. 3-II

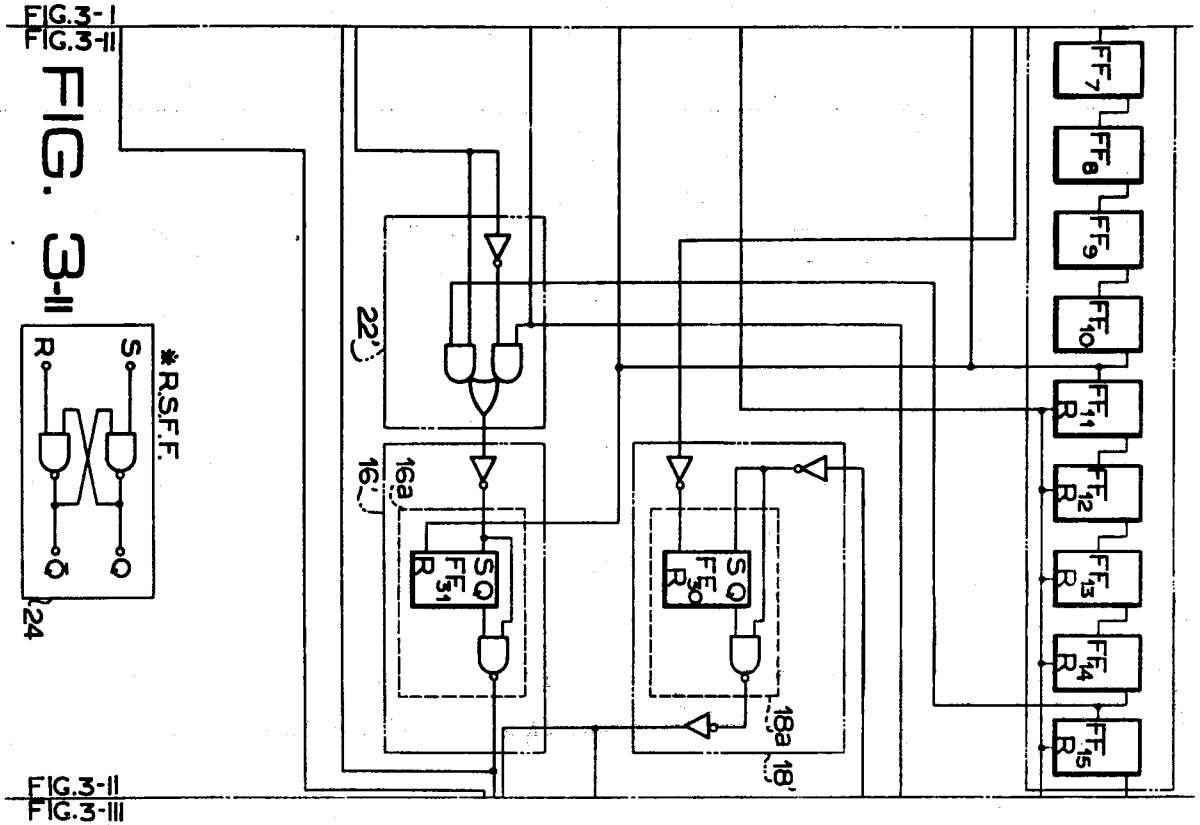
FIG. 3-II

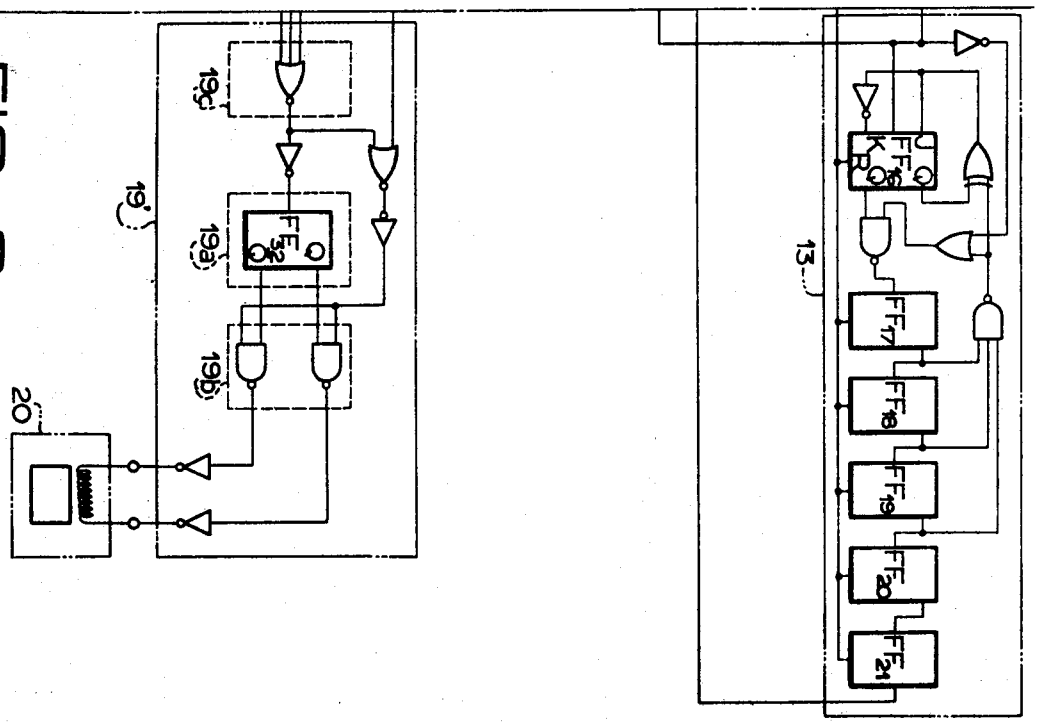
FIG. 3-III
FIG.3-II
FIG.3-III

ELECTRONIC TIMEPIECE

BACKGROUND OF THE INVENTION

This invention relates to an electronic timepiece provided with a pitch measuring system and, more particularly, to an electronic timepiece whose minimum display changing time interval is relatively long, (that is to say on the order of 5 seconds to 2 minutes) and is provided with a pitch measuring system.

DESCRIPTION OF THE PRIOR ART

A timepiece whose minimum display changing time interval is relatively long that is to say on the order of 5 seconds to 2 minutes such, as for example, an hour minute display liquid crystal timepiece or a two hand display crystal timepiece has recently been developed. In such timepieces, it is impossible to measure a time interval between changeable displays so as to calculate a stepping rate or pitch thereof. This is because, in the case of a two hand crystal timepiece wherein a hand moves at an interval of minute, 10 minutes are required in order to obtain measured results of 10 points, and as a result, it takes a long time for the pitch measurement. If it is desired to adjust the pitch two or three times for the purpose of making the pitch small, times on the order of 1 hour elapse during such pitch adjustment. As a practical matter, such adjustments are of pitch, therefore, not used.

This kind of timepiece has other various disadvantages. For example, if a pitch or stepping rate detecting signal is superimposed on a driving signal, the measurement becomes erroneous due to phase differences between these two signals. In addition, a driving pulse produced by the driving signal has a voltage determined by a battery and a pulse width determined by a frequency division circuit so that it is difficult to bring the driving pulse into in coincidence with the characteristics of a step motor.

Moreover, in a step motor type electronic timepiece driven by alternate pulses, a stationary polarity of the step motor is memorized by a phase memory circuit so as to define an output pulse polarity by the driving circuit and by the following driving pulses. As a result, if replacement of a battery with a new one deprives the phase memory circuit of its memory, there is a 50 % risk of the step motor being not started by the following driving pulses.

If a hand of a timepiece is moved by a set of positive and negative pulses, it is difficult to adjust the step motor at that phase which is intermediate between these pulses.

In a step motor type timepiece in which the minimum change time interval of the display time is one minute, hands become moved when repairing a fault or replacing a battery by a new one, and as a result, it takes at least 1 minute to 2 minutes in order to ascertain that the timepiece is normally operating, thereby making a manufacturer uneasy or unsure that the timepiece is running.

In order to move a hand in a stepwise manner every minute or in units of a minute, the hand must be fitted to a hand shaft such that the hand precisely indicates minute times and the time must be corrected such that the minute hand precisely indicates the minute times. This results in troublesome operation.

In the case of fitting a hand to a hand shaft, it is desirous to loosely fit the hand to the hand shaft such that the hand can move ±10° with respect to the stationary hand shaft for the purpose of improving the workability.

In a highly precise timepiece, it is often sufficient to set the second hand only to the desired time and it is desirable to effect correction by a time signal in one operation.

In an 1 minute step timepiece, a hand has to move from a correct time every 1 minute even though it requires longer than 1 minute to correct times.

It is desirable to provide a second return to zero circuit or a circuit which returns its second count to zero which is simple in construction and reliable in operation.

In a timepiece which makes use of a step motor, if a hand is corrected by means of an exteriorly operable member without stopping the operation of a frequency division circuit and count circuit, signals from a driving circuit for driving the step motor are superimposed one upon the other when the correction is started or completed, and as a result, a signal having a complete pulse width is absent and normal operation is not effected immediately after completion of the correction. This makes the operation significantly unreliable. In addition, in a timepiece with no second display, it is required to ascertain when there is a second return to zero operation, otherwise a wearer feels uncertainty, which is an inconvenience.

SUMMARY OF THE INVENTION

An object of the invention is to provide an electronic timepiece provided with a reference oscillator, which is capable of deriving from an intermediate stage of a frequency division circuit a fast detecting pulse having a small pulse width, and superimposing it on a display signal and detecting it so that the pitch, rate or stepping rate of a time interval between changeable displays can easily be measured.

A second object of the invention is to provide a hand type electronic timepiece wherein an electromechanical transducer having a driving coil is provided for effecting no response but producing only a magnetic field which can magnetically ascertain a detecting pulse derived from a frequency division circuit.

A third object of the invention is to provide a step motor type two hand electronic timepiece which makes use of a pich or stepping rate detection means.

A fourth object of the invention is to provide an electronic timepiece wherein a detecting signal circuit is provided for predominantly passing a detecting signal when it is superimposed on a display signal and which can measure a pitch or stepping rate without disturbing a driving signal.

A fifth object of the invention is to provide an electronic timepiece wherein a pitch detection means is provided for composing a driving signal having any desired pulse width by means of a plurality of output pulses delivered from a frequency division circuit and having different pulse widths.

A sixth object of the invention is to provide a step motor type electronic timepiece wherein a pitch detection means is provided for stopping the timepiece at any desired second position of a hand movement display means and for completely restarting the timepiece.

A seventh object of the invention is to provide a step motor type electronic timepiece wherein a pitch detection means is provided for defining the intermediate portion of alternate pulses of a set of alternate pulses constituting a driving pulse by means of a manually operable switch.

An eighth object of the invention is to provide a step motor type electronic timepiece wherein a pitch detection means is provided, which is operated when a used battery is replaced by a new battery to bring the initial phases between an electromechanical transducer and a driving circuit for driving it into coincidence with each other and reliably move hands within a defined time.

A ninth object of the invention is to provide a step motor type electronic timepiece which is operated when a used battery is needed to be replaced by a new battery to operate an electromechanical transducer a number of times, for example, about ten times with a time interval shorter than 5 seconds to 2 minutes for the purpose of rapidly notifying an operator who replaces the battery or repairs the timepiece that the timepiece is stopped owing to exhaustion of capacity of the battery.

A tenth object of the invention is to provide a step motor type electronic timepiece which, when the timepiece is out of order, is capable of discerning whether the defect has occurred in electrical circuitry proceeding a driving circuit or whether the defect has occurred in an electromechanical transducer, gear train or the like following the driving circuit; wherein the timepiece is also capable of operating the electromechanical transducer with a time interval which is shorter then 5 seconds to 2 minutes and hence is capable measuring a time interval pitch between changeable displays within a short time and is therefore capable of adjusting mechanical parts of the electromechanical transducer within a short time by the same operation as is done when the battery is replaced by a new battery or by operating another switch arranged at a separate position while detecting the output from the driving circuit.

An eleventh object of the invention is to provide a step motor type electronic timepiece which, when a battery is replaced by a new one, is capable of mechanical adjustment parts of an electromechanical transducer under such condition that an operator can see an hour hand and minute hand by operating an exteriorly operable member such as a winding crown or by operating a member indirectly connected to a movement of a timepiece such as a magnet and associated reed switch.

A twelfth object of the invention is to provide a step motor type electronic timepiece which is capable of aligning a minute hand with a graduation on a dial or with a point between two adjacent graduations when effecting hand alignment.

A thirteenth object of the invention is to provide a step motor type electronic timepiece wherein a hand alignment mechanism is provided for always correcting a minute hand to a definite minute interval and not a portion of a minute.

A fourteenth object of the invention is to provide a step motor type electronic timepiece which comprises; an oscillation circuit which utilizes a crystal oscillator; a second count circuit or rather a circuit for counting seconds which is supplied with a signal from said oscillation circuit as an input and delivers a minute signal as an output; a second return to zero circuit; or a circuit which returns a second count (time) to zero a minute drive control circuit supplied with outputs from said second count circuit and from said second return to zero circuit through a logical sum circuit; a step motor adapted to be rotated in a stepwise manner by means of said minute drive control circuit and by a minute output signal thereof; means whereby said second return to zero circuit can discriminate whether the contents of said second return to zero circuit are less than 30 seconds or more than 30 seconds and, only when said contents are more than 30 seconds, produce an output for advancing said step motor by one step; an output circuit for clearing said second count circuit whereby the second return to zero operation which defines the minute hand position is effected; a minute set switch for setting said minute drive control circuit, said minute set switch being exteriorly operated so as to set said minute drive control circuit in phase with said step motor while normally moving those time intervals which are less than a minute.

A fifteenth object of the invention is to provide a step motor type electronic timepiece wherein a circuit is provided for deriving a timing pulse when second return to zero operation is effected and wherein said circuit is convenient for deriving said timing pulse and is simple in construction.

A sixteenth object of the invention is to provide an electronic timepiece provided with a step motor which is always supplied with a signal having a constant width so as to reliably effect a hand correction operation.

A seventeenth object of the invention is to provide an electronic timepiece provided with a step motor wherein a light emitting diode is provided for displaying the fact that a second return to zero operation is effected.

The above and other objects of the invention will become more apparent from the following description and accompanying drawings forming part of this application.

BRIEF DESCRIPTION OF THE DRAWINGS

FIG. 3 is an electronic circuit diagram showing in detail another embodiment of the invention;

DETAILED DESCRIPTION OF THE PREFERRED EMBODIMENTS:

The invention will now be described with reference to the embodiments according to the invention.

Figure 1:
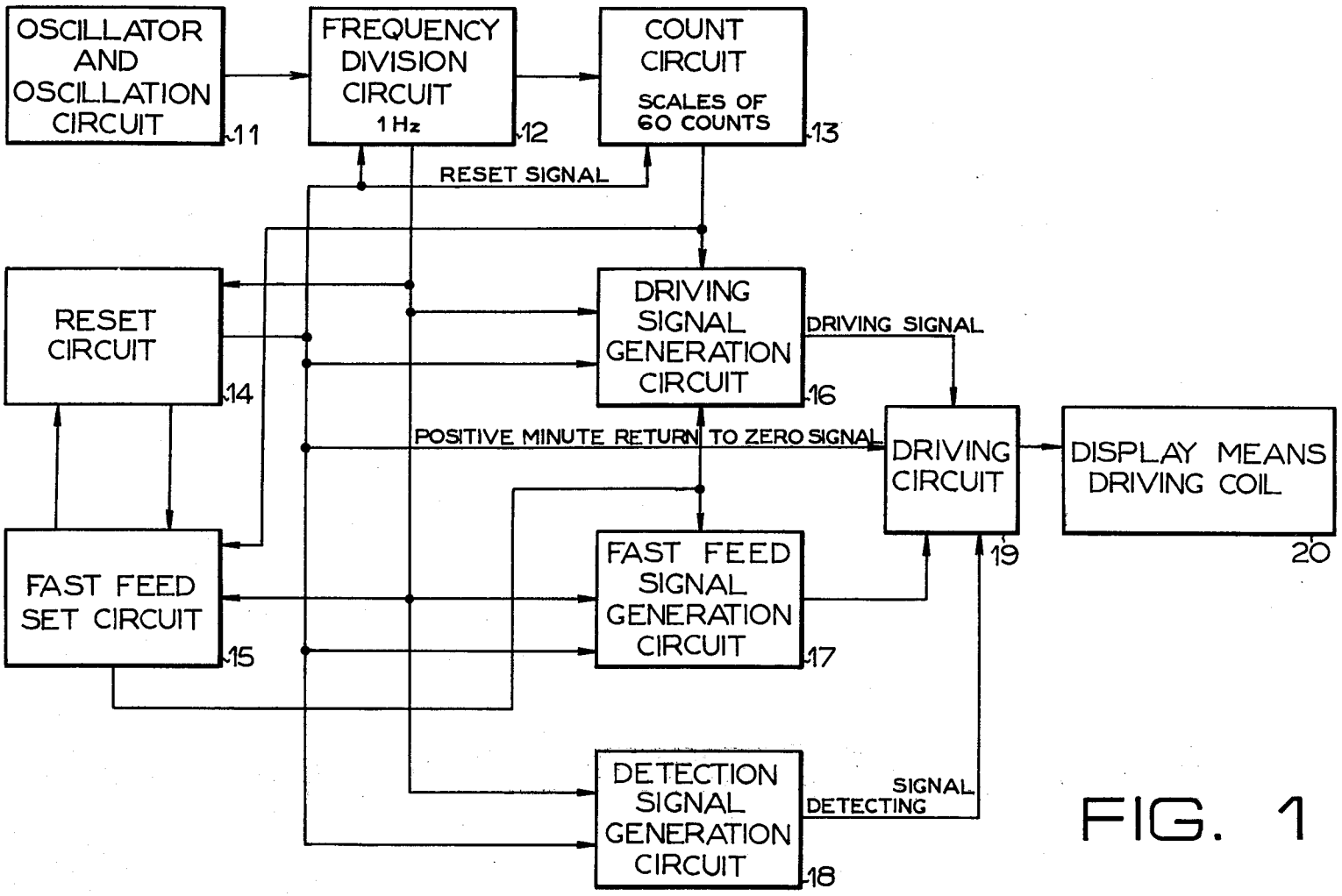
FIG. 1 is a block diagram showing an electronic timepiece circuit connected and arranged according to the invention.

In FIG. 1 shows a circuit block diagram of the invention. Reference numerals 11-12 designate the following circuits: 11 a reference oscillator and oscillation circuit; 12, a frequency division circuit for effecting in succession frequency division of an output from the oscillation circuit 11 to obtain a rectangular wave of 1 Hz; 13, a count circuit for effecting scale of 60 counts, 14 a reset circuit for effecting a resetting operation by means of an exteriorly operable member and a positive minute return to zero operation; 15, a fast feed reset circuit for effecting a resetting operation by means of an exteriorly operable member and effecting a switching over between an ordinary driving operation and a fast feed driving operation; 16, a driving signal generation circuit for generating a driving signal which displays ordinary times; 17, a fast feed signal generation circuit for generating a fast feed signal when the fast feed operation is effected; 18, a detecting signal generation circuit for generating a step detecting signal; and 19, a driving circuit for supplying signals generated from respective signal generation circuits to a display means 20 to display times.

Each of the above described circuit blocks 11–20 will be described in greater detail with reference to FIG. 2. Only the operation of and connection between respective circuit blocks will now be described. A 32,768 Hz signal generated from the reference oscillator and oscillation circuit 11 is shaped in wave form and then supplied to the frequency division circuit 12 which serves to effect 15 stage frequency division whereby an 1 Hz signal is generated. This 1 Hz signal is supplied to and counted by the count circuit 13 to produce an 1 minute signal which is supplied to the driving signal generation circuit 16 and at the same time to the fast feed reset circuit 15 which cooperates with a 32 Hz signal delivered from the frequency division circuit 12 to automatically release the fast feed signal. Both the 32 Hz signal and a 16 Hz signal delivered from the frequency division circuit 12 are supplied to the driving signal generation circuit 16 to determine duty of the driving signal. In addition, the 32 Hz signal serves to determine duty of the fast feed signal of the fast feed signal generation circuit 17 and also determine duty of the positive minute return to zero signal of the reset circuit 14. A 2 Hz signal delivered from the frequency division circuit serves to determine a repetition period of the fast feed signal generation circuit 17. Both the 1 Hz signal and a 4096 Hz signal delivered from the frequency division circuit 12 determine a repetition period and duty of the detecting signal generation circuit 18.

The reset circuit 14 serves to reset both the frequency division circuit 12 and count circuit 13 by the exteriorly operable member to stop signals from respective signal generation circuits 16 17, 18 and deliver the positive minute return to zero signal to the driving circuit 19 on the one hand and control the operation of the fast feed reset circuit 15 on the other hand.

The fast feed reset circuit 15 is capable of delivering a control signal, which can change over the ordinary driving signal to the fast feed signal and vice versa, to both the driving signal generation circuit 16 and the fast feed signal generation circuit 17 so as to control these circuits by the exteriorly operable member. In addition, the fast feed reset circuit 15 serves to reset both the frequency division circuit 12 and the count circuit 13 during the operation of the exteriorly operable member.

The driving signal generation circuit 16 serves to produce two kinds of driving signals each having a pulse width of 16 ms and displaced in phase by about 32 ms from each other at a repetition period of 1 minute with the aid of the 1 minute signal, 32 Hz signal and 16 Hz signal, respectively. These driving signals are delivered to the driving circuit 19. The fast feed signal generation circuit 17 serves to produce two kinds of fast feed signals each having a pulse width of 16 ms and displaced in phase by ½s from each other at a repetition period of 1 second with the aid of the 2 Hz signal and 32 Hz signal, respectively. These fast feed signals are delivered to the driving circuit 19. The detecting signal generation circuit 18 serves to produce a detecting signal having a pulse width of 120 μs at a repetition period of 1 second with the aid of the 1 Hz signal and 4096 Hz signal, respectively. This detecting signal is delivered to the driving circuit 19.

The driving circuit 19 serves to divide the signals supplied from respective generation circuits 16, 17, 18 and the positive minute return to zero signal supplied from the reset circuit 14 into two sets of signals. These two sets of signals are amplified and then supplied to both ends of a driving coil of the display means 20, thereby moving hands of a timepiece.

The operation of and connection between respective circuit blocks have briefly been described with reference to FIG. 1. The construction and operation of respective circuit blocks will now be described in greater detail with reference to FIG. 2 which shows an embodiment according to the invention. The circuit blocks shown in FIG. 2 are capable of converting 1 minute pulses into rotations of a step motor and incorporated into an electronic timepiece provided with two hands which can be moved by steps having an interval of 1 minute.

Figures 1, 2:
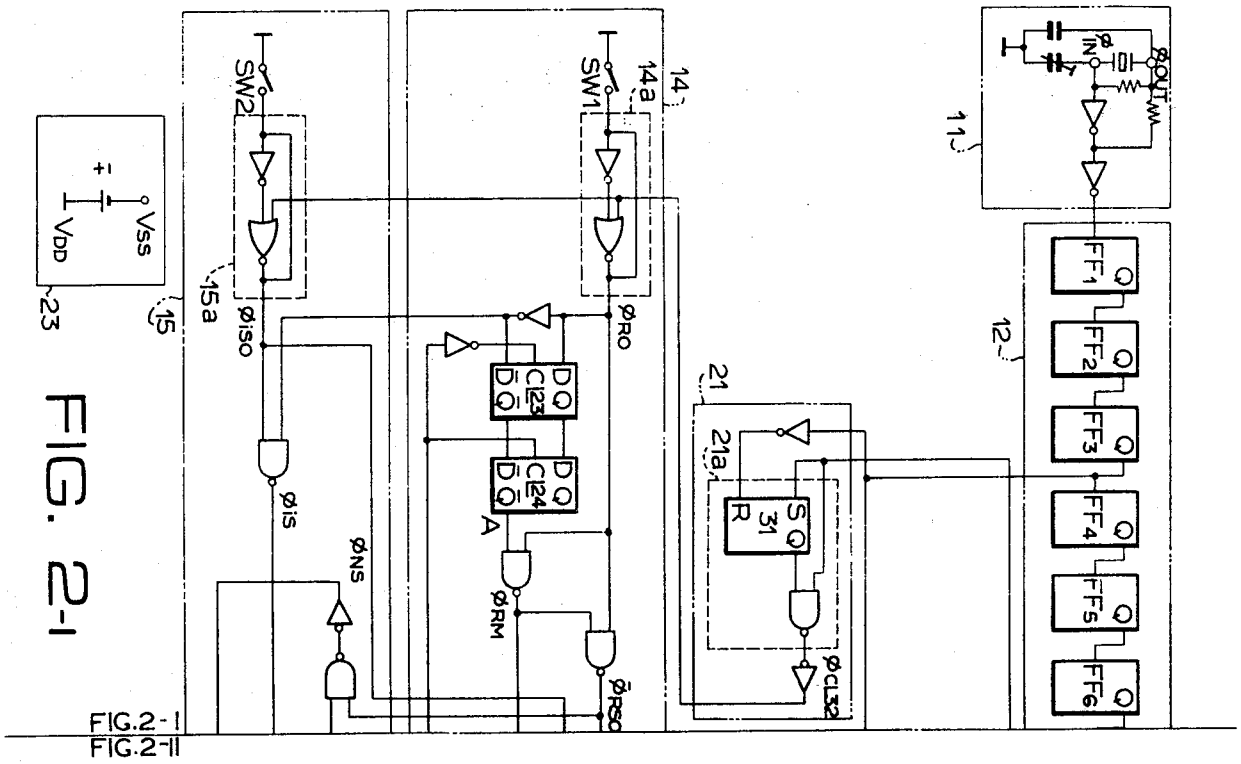
FIG. 2 is an electronic circuit diagram showing in detail one embodiment of the invention.

In FIG. 2 is shown an embodiment of an integrated circuit incorporated into the electronic timepiece shown in FIG. 1. Like reference numerals shown in FIG. 2 designate like parts shown in FIG. 1.

Reference numeral 21 designates a switch control signal generation circuit which serves to produce a switch control signal whose pulse width is about 120 μs at a repetition period of about 32 ms with the aid of the 32 Hz signal and 4096 Hz signal. Circuit 22 is a change over circuit which serves to discriminate between the output condition of the fast feed reset circuit 15 and change over between the ordinary driving operation and the fast feed operation. Circuit 23 illustrates an electric battery, and circuit 24 a circuit construction of reset set flip-flops FF inclusive of flip-flops $FF_{26}$ to $FF_{31}$.

All of the flip-flops FF, inclusive of the flip-flops $FF_1$ to $FF_{31}$, are adapted to be operated upon being negatively triggered. All of the circuits inclusive of the reference oscillator and oscillation circuit 11, frequency division circuit 12 and count circuit 13 are of conventional design and are used in general electronic timepieces so that detailed explanations thereof are not necessary.

The switch control signal generation circuit 21 serves to produce a switch control signal by inverting an output from a wave form shape circuit 21*a* composed of a flip-flop $FF_{31}$ and a NAND gate.

An input set terminal S of the flip-flop $FF_{31}$ of the wave form shape circuit 21*a* is supplied with the 32 Hz signal from the frequency division circuit 12 and an input reset terminal R of the flip-flop $FF_{31}$ is supplied with a 4096 Hz signal through an inverter. The 4096 Hz input signal having a shorter period leads the 32 Hz input signal in phase. An output Q from the flip-flop $FF_{31}$ is a signal which is displaced in phase by about 120 μs from an opposite phase of the 32 Hz signal.

If the output Q and the 32 Hz signal are added in a NAND gate, the output from the NAND gate becomes "L" during ½ period (120 μs) of a signal having a shorter period when a signal having a longer period (32 Hz) changes from "L" to "H".

Now, the reset circuit 14 will be described. Reference numeral 14*a* designates a switch control circuit composed of a NOR gate and an inverter. The switch control circuit 14*a* constitutes a memory circuit adapted to be controlled by a clock pulse $\phi CL_{32}$ delivered from the switch control signal generation circuit 21.

If an exteriorly operable switch $SW_1$ is closed, an output $\phi RO$ from the switch control circuit 14*a* becomes "H". The output $\phi RO$ and an output A from the flip-flop $FF_{24}$ and the NAND gate serve to produce a positive minute return to zero signal $\phi RM$ which is delivered to the driving circuit 19. The pulse of the positive minute return to zero signal $\phi RM$ is changed from 16 ms to 48 ms in response to the timing of the exteriorly operable switch $SW_1$. The reset signal $\phi RS$ is delayed by a pulse width of the positive minute return to zero signal $\phi RM$. If the exteriorly operable switch $SW_1$ is opened again, the output $\phi RO$ from the switch control circuit 14*a* becomes "L" in synchronism with the clock pulse $\phi CL_{32}$ to release the reset.

The fast feed reset circuit 15 will now be described.

A switch control circuit 15*a* operates in the same manner as the switch control circuit 14*a* and constitutes a control circuit for an exteriorly operable switch $SW_2$. An output $\phi iso$ from the switch control circuit 15*a* is supplied through a NAND gate the gating of which is controlled by the reset circuit 14 and is applied to an input set terminal S of the flip-flop $FF_{30}$. As a result, the operation under the reset condition of the timepiece becomes non-effective. If an exteriorly operable switch $SW_2$ is closed under the normal time, that is, the time system is in operative, the output $\phi iso$ from the switch control circuit 15*a* causes the flip-flop $FF_{30}$ to set so as to change an output $\overline{Q}$ from the flip-flop $FF_{30}$ from "H" to "L".

The change over circuit 22 serves to change over between an 1 minute signal and a ½ second signal with the aid of the condition of the output $\overline{Q}$ from the flip-flop $FF_{30}$. This 1 minute signal is delivered to the driving signal generation circuit 16 under the normal time, that is, when the time system is operating, to step the ½ second signal. At the time of the fast feed operation, when the output $\overline{Q}$ from the flip-flop $FF_{30}$ is at "L" level, the ½ second signal is delivered to the fast feed signal generation circuit 17 to stop the 1 minute signal. Now, let it be assumed that the exteriorly operable switch $SW_2$ of the fast feed reset circuit 15 is closed to make the output $\overline{Q}$ from the flip-flop$_{30}$ "L". When the exteriorly operable switch $SW_2$ is open, the output $\phi iso$ from the switch control circuit 15*a* becomes a reset signal $\phi RS$ from the reset circuit 14, thereby resetting the frequency division circuit 12, the count circuit 13 and the flip-flop $FF_{22}$, respectively. If the exteriorly operable switch $SW_2$ is opened again, after 1 minute has been elapsed, the output Q from the flip-flop $FF_{22}$ is changed from "L" to "H" and is added through the NAND gate to the 32 Hz signal so that the fast feed set is automatically released after the lapse of 120.16 *s*. Under the fast feed operation, if the exteriorly operable switch $SW_1$ of the reset circuit 14 is closed, the fast feed set is forcedly released after the positive minute return to zero signal $\phi RM$ has been delivered. As seen from the above, description the reset circuit 14 is predominant over the fast feed reset circuit 15.

The driving signal generation circuit 16 will now be described. The driving signal generation circuit 16 serves to produce a driving signal which can move the display means 20 in response to the time system. The 32 Hz signal output from the flip-flop $FF_{10}$ of the frequency division circuit 12, the 16 Hz signal output from the flip-flop $FF_{11}$ and the 1 minute signal output from the flip-flop $FF_{21}$ of the count circuit 13 serve to produce two driving signals. One of these driving signals is a driving signal $\phi DPA$ which has a pulse width of 16 ms at a repetition period of 1 minute. The signal DPA passes through a wave form shape circuit 16*a* which operates in the same manner as the wave form shape circuit 21*a* with the aid of the 32 Hz signal $\phi CL_1$. This is passed through the NOR gate controlled by the reset signal $\phi RS$ with the aid of the 1 minute signal controlled by the change-over circuit 22. The other driving signal serves to produce a pulse which has a pulse width of 48 ms at a repetition period of 1 minute and which passes through a wave form shape circuit 16*b* which operates in the same manner as the wave form shape circuit 21*a* with the aid of a signal having a pulse width of 48 ms at a period of 46 ms and with the aid of the 1 minute signal controlled by the change-over circuit 22. The signal having the pulse width of 48 ms is obtained by inverting the phase of the output from a logical sum circuit 16*c* which is supplied with a signal which is opposite in phase to the output Q from the flip-flop $FF_{10}$ and drives the following flip-flop $FF_{11}$ and which is supplied with an output which is opposite in phase to the output Q from the flip-flop $FF_{11}$, that is, by inverting the phase of the 32 Hz signal and of a signal obtained from the 16 Hz signal after it has passed through a NAND gate 16*c* by means of an inverter and by passing the output from the logical sum circuit 16*c* through a NOR gate controlled by the reset signal $\phi RS$. The above mentioned signal $\phi DPA$ having the pulse width of 16 ms at the period of 1 minute and the 32 Hz signal $\phi CL_1$ are supplied to the three input gates as their input signals, respectively. The output $\phi DPA$ from these three input gates is used to produce a signal $\phi DPB$ having a pulse width of 16 ms at a period of 1 minute and lagged in phase from the output $\phi DPA$ by 32 ms.

The fast feed signal generation circuit 17 operates in the same manner as the wave form shape circuit 21*a* with the aid of the 32 Hz signal $\phi CL_1$ controlled by the above mentioned reset signal $\phi RS$ and the output Q from the flip-flop $FF_{14}$ of the frequency division circuit 12 controlled by the change-over circuit 22.

A wave form shape circuit 17*a*, provided for the fast feed signal generation circuit 17, serves to produce a signal having a pulse width of 16 ms with a period of ½ second. This signal is supplied as a clock pulse to a flip-flop $FF_{25}$ for effecting a ½ frequency division. Outputs Q,$\overline{Q}$ from the flip-flop $FF_{25}$ are supplied to one input terminal of each of two NAND gates and a signal inverted in phase of the above mentioned signal having the pulse width of 16 ms at the period of ½ second is supplied to the outer input terminal of each of the two NAND gates. These two NAND gates serve to produce two kinds of signals $\phi iDA$ and $\phi iDB$ each having a pulse width of 16 ms at a period of 1 second and displaced in phase by ½ second from each other.

The 4096 Hz output from the flip-flop $FF_3$ of the frequency division circuit 12 is supplied through a NOR gate controlled by the reset signal $\phi RS$ and a signal obtained by inverting the phase of the 1 Hz output from the flip-flop $FF_{15}$ of the frequency division circuit 12 is supplied to a wave form shape circuit 18*a* of the detecting signal generation circuit 18 to produce a signal $\phi SP$ having a pulse width of 120 $\mu s$ with a period of 1 second.

The driving circuit 19 serves to divide a group of signals produced by the above mentioned respective signal generation circuits and the positive minute return to zero signal $\phi RM$ produced by the reset circuit 14 into two signal systems. One of these two signal systems consists of a group of signals $\phi$SP, $\phi$DPA and $\phi$iDA and the other signal system consists of a group of signals $\phi$DPB, $\phi$iDB and $\phi$RM. These two groups of signals are applied across a driving coil of the display means 20 to drive a step motor which is an electromechanical converter of the display means 20 in a stepwise manner.

The display means 20 serves to transmit the stepwise movement of the step motor through a gear train to a hand of a timepiece, and as a result, the hand is moved to display times.

As stated hereinbefore, the embodiment of the invention according to the invention shown in FIG. 2 has been applied to an integrated circuit incorporated into a timepiece.

In FIG. 3 is shown a second embodiment of the invention applied to an electronic timepiece. Similar parts are designated by similar reference numerals in FIGS. 2 and 3.

Reference numerals 11–20 designate the following circuits: 11 a reference oscillator and oscillation circuit such as one shown in FIG. 2; 12, a frequency division circuit which is the same as that shown in FIG. 2 and can effect a frequency division from 32,768 Hz to 1 Hz by means of flip-flops $FF_1$ to $FF_{15}$; 13, a count circuit which is the same as that shown in FIG. 2 and can effect scale of 60 counts; 21, a switch control signal generation circuit which is the same as that shown in FIG. 2 and can control the switch operation of the switch control circuits 14*a*, 15*a* and 31*a*; 14, a reset circuit which is controlled by clock pulses with the aid of the switch control circuit 14*a* shown in FIG. 2 and can produce one shot pulse with the aid of flip-flops $FF_{22}$, $FF_{23}$ and a NAND gate when the exteriorly operable switch $SW_1$ is closed to reset the flip-flops $FF_{11}$ to $FF_{15}$ of the frequency division circuit 12 and the count circuit; 13, respectively. The above described one shot pulse which is a reset signal coincides in timing with a driving signal generation circuit 16 and is derived from the same pulse generation part. If counts of the count circuit 13 are 30 to 59, that is, if at least one fast feed signal is delivered from the flip-flops FF, a first fast feed signal causes an output Q from a flip-flop $FF_{27}$ of a fast feed reset circuit 15 to change from "L" to "H". Then, if the exteriorly operable switch $SW_1$ of the reset circuit 14 is closed, it is possible to change the fast feed operation to the ordinary feed operation. That is, if at least one fast feed signal is produced, it is possible to bring the phase of the fast feed signal generation circuit 17 into in coincidence with the phase of the display means 20. As a result, an initial phase coincidence is possible. In addition, if predetermined number of fast feed signals are produced, the fast feed operation is automatically changed into the ordinary feed operation with the aid of the output Q from the flip-flop $FF_{21}$ of the count circuit 13 which also operates as a timer circuit, and operations with the aid of the output Q from the flip-flop $FF_{10}$ of the frequency division circuit 12.

Reference numeral 31 designates a minute hold circuit. As described above, a switch control circuit 31*a* is an input circuit which is controlled by clock pulses to control the input supplied to a minute hold switch $SW_3$. If the minute hold switch $SW_3$ is closed, the output Q from a flip-flop $FF_{28}$ of a timing adjustment circuit 31*b* becomes "H" level in the absence of the driving signal from the driving signal generation circuit 16. If the output from the minute hold switch $SW_3$ becomes "H" level again, a driving signal is produced to move the step motor of the display means 20 by one step. In addition, if counts of the count circuit 13 are 0 to 29, the count circuit 13 is reset to 0 second, that is, the count circuit 13 serves as a second return to zero circuit. In order to confirm that the count circuit 13 is reset to 0 second, a display element such as a light emitting diode LED is ignited for a pulse width of 16 ms of the above described one shot pulse or reset signal. This light emitting diode circuit is designated by reference numeral 33 in FIG. 3.

Reference numeral 15 designates a fast feed reset circuit. Circuit 32 shows an initial set circuit which constitutes a differential circuit composed of a condenser and a resistor and which can produce two signals each having a pulse width of which is dependent on a time constant thereof only when a battery 23 is connected thereto. These two signals are supplied to a NOR gate which changes these two signals into the same system of signals which cause the output $\overline{Q}$ from a set-reset flip-flop $FF_{24}$ to change from "L" to "H", thereby changing a signal passing through the change over circuit 22 from the 1 minute signal to the ½ second signal and simultaneously resetting the frequency division circuit 12, count circuit 13 and flip-flop $FF_{27}$, respectively.

As described above, after the fast feed has been set, the driving signal is prevented from being transmitted from the driving signal generation circuit 16 to the driving circuit 19 until the minute hold switch $SW_3$ becomes opened. If the minute hold switch $SW_3$ is opened again, an output Q from a flip-flop $FF_{28}$ of the timing adjustment circuit 31*b* is changed from "H" to "L" in the absence of the driving signal in the same manner as in the case of changing the output Q from "L" to "H". That is, the timing adjustment circuit 31*b* serves to adjust the timing at the time of starting the control by the minute hold switch $SW_3$ and to adjust the timing at the time of ending the control of the minute hold switch $SW_3$. In addition, the minute hold switch $SW_3$ is interlocked with an exteriorly operable member for correcting hands of a timepiece.

Reference numeral 18 designates a detecting signal generation circuit which is capable of producing a detecting signal having a pulse width of 120 $\mu$s at a repetition period of 1 second by means of a wave form shape circuit 18*a* as in the case of the wave form shape circuit 21*a* shown in FIG. 2.

Reference numeral 16 designates a driving signal generation circuit which also plays the role of the fast feed signal generation circuit 17 shown in FIG. 1. The one minute signal or the ½ second signal selected by a change-over circuit 22 and the 32 Hz signal serves to produce a signal having a pulse width of 16 ms at a repetition period of 1 minute during ordinary operation when the time system is moving and to produce a signal having a pulse width during 16 ms at a repetition period of ½ second of fast feed operation.

Reference numeral 19 designates a driving circuit which causes the driving signal to lag with respect to the detecting signal by a pulse width of 120 $\mu$s of the detecting signal when the driving signal is superimposed on the detecting signal with the aid of a detecting signal predominance circuiit 19*c* gate controlled by means of the minute hold circuit 31. This lagging of the driving signal with respect to the detecting signal is necessary since there is a risk of the measurement of pitch or of the stepping rate being disturbed by the presence of the driving signal. The driving signal which has passed through the detecting signal predominance circuit 19c serves as a clock pulse for a flip-flop $FF_{32}$ of a phase inversion circuit 19a. The driving signal is coupled again with the detecting signal through the logical sum circuit and converted into two series of driving signals by means of a phase control circuit 19b. The phase control circuit 19b is gate controlled by the output $Q,\overline{Q}$ from the flip-flop $FF_{32}$ of the phase inversion circuit 19a to apply the two series of driving signals each having a pulse width of 16 ms at a repetition period of 2 minutes and displaced in phase from each other by 1 minute across two terminals of a driving coil of a display means 20, thereby stopping the step motor. To the driving coil of the display means 20 is also applied a detecting signal having a period of 1 second in the same direction as the driving signal, thereby rendering it possible to effect the pitch or stepping rate measurement.

Reference numeral 33 designates a second return to zero detection circuit in which the above mentioned set signal causes a NPN transistor for making the light emitting diode LED conductive. As a result, the light emitting diode LED becomes ignited which renders it possible to confirm the reset operation.

Reference numeral 24 illustrates in detail a set of reset flip-flops FF inclusive of flip-flops $FF_1$ to $FF_{32}$.

Mechanical parts of the electronic timepiece according to the invention will now be described with reference to FIGS. 4, 5 and 6.

Figure 4:
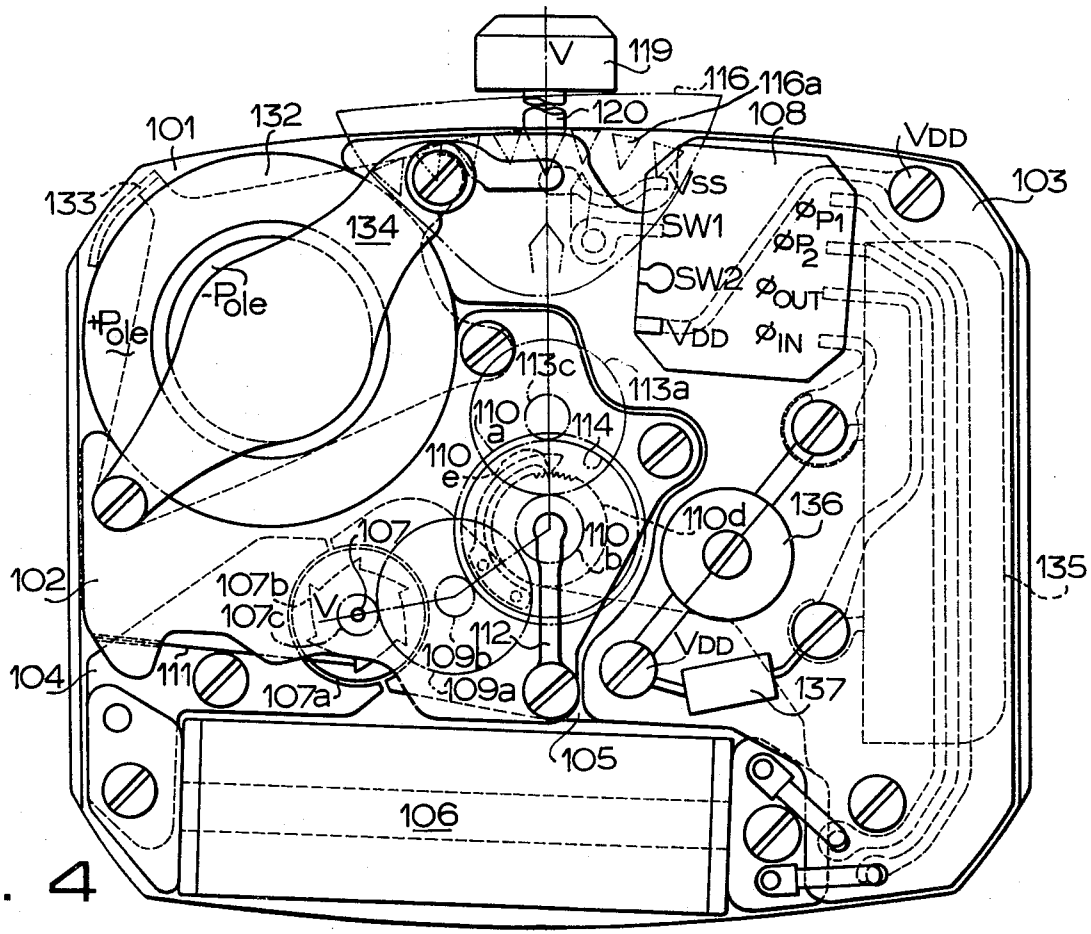
FIG. 4 is a plan view of an electronic timepiece suitable for use in the electronic circuit shown in FIG. 2, the parts being viewed from a back lid side.

FIG. 4 is a plan view of a movement viewed from the back lid side thereof. Reference numeral 101 designates a timepiece substrate provided on its upper surface with a gear train support 102 secured by screws to the timepiece substrate 101 and with a circuit block 103 also secured by screws to the timepiece substrate 101. Between the timepiece substrate 101 on the one hand and the gear train support 102 and circuit block 103 on the other hand are arranged stators 104, 105 of a step motor secured by screws to the substrate 101. Onto the stators 104, 105 is secured by screws, a core 107' with a coil 106 wound around it. The stators 104, 105 are provided with a circular space in which is arranged a rotor composed of a rotor body 107a, a ratchet wheel 107b and a rotor pinion 107c made integral with each other. The rotor 107 is rotatably journaled by the substrate 101 and gear train support 102. The rotor body 107a is made of a permanent magnet. The rotor body 107a, stator 104, 105 and core 107' constitute a magnetically stable magnetic circuit. The ratchet wheel 107b is prevented from being rotated in an opposite directon by means a spring 111 secured at one end to the gear train support 102 and engaged at the other end with the ratchet wheel 107b as shown in FIG. 5. The coil 106 wound around the core 107' is electrically connected to terminals $\phi P_1$ and $\phi P_2$ of an integrated circuit block 108 secured to the upper surface of the circuit block 103. The rotor pinion 107c is threadedly engaged with a gear 109a of a reduction gear 109 provided with a pinion 109b and rotatably journaled by the substrate 101 and the gear train support 102. The pinion 109b of the reduction gear 109a is threadedly engaged with a second wheel body 110a which is rotatably journaled through a cannon wheel 114 by the gear train support 102 and the substrate 101. To the second wheel pinion 110b is secured a resilient claw or pawl 110e which is engaged with a pitch determination gear 110d provided with 60 triangular teeth and secured to the second wheel pinion 110b. The second wheel pinion 110b is threadedly engaged with a minute wheel 113a rotatably journaled by the gear train support 102 and a lower surface support 115. The lower surface support 115 is secured by screws to that side of the substrate 101 which is located adjacent to a dial 116 of a timepiece. To the lower surface support 115 is secured a centering ring member 115a for use in the dial 116. The minute gear 113a is made integral with a minute gear 113b and minute wheel pinion 113c to constitute a minute gear 113. Between the movement and the dial 116 is sandwiched a magnetic shield plate 117. The minute pinion 113c is threadedly engaged with a cannon gear 114 freely fitted about the second pinion 110b and rotatably journaled in the substrate 101 and the centering ring member 115a of the lower surface support 115. The cannon gear 114 is urged against the substrate 101 by means of a spring washer 127. The second pinion 110b and cannon gear 114 are provided at their lower ends with circular notches partly broken away by chords, respectively. A minute hand 125 and an hour hand 126 are provided at their portions to be fitted around the second pinion 110b and cannon gear 114 with circular holes partly broken away by chords or flates 125a, 126a, respectively. These chords 125a, 126a permit a movement of more than one step of the hands around the second pinion 110b and cannon gear 114, respectively, in a more or less rotatable manner such that the hands can precisely be aligned with the minute graduations of the dial.

Figure 5:
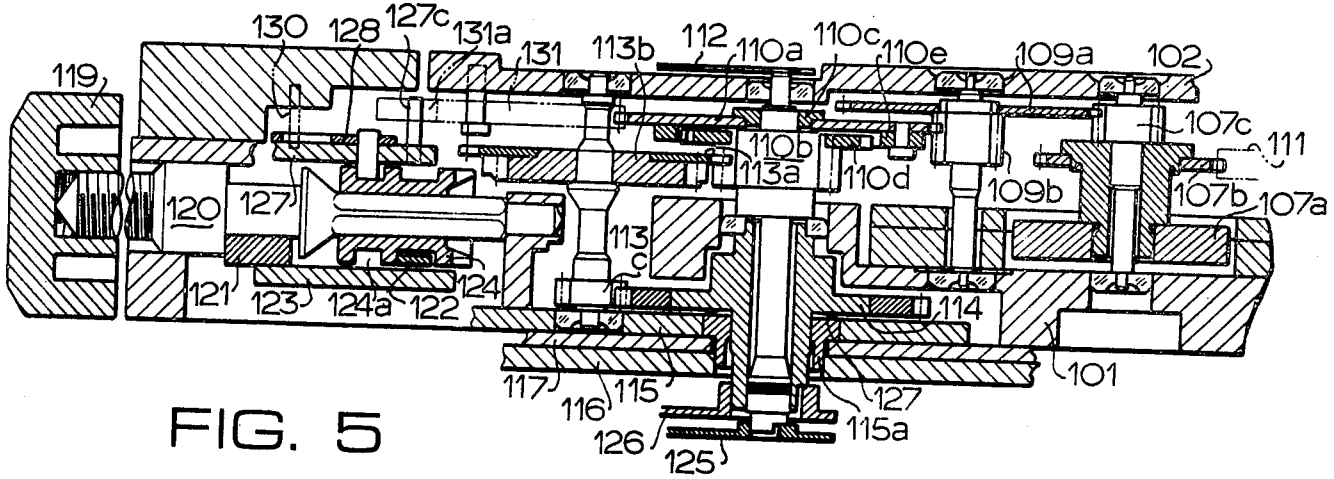
FIG. 5 is a section on line V—V of FIG. 4.

Provision is made for a clutch wheel 124 adapted to be moved inwardly and threadedly engaged with the minute gear 113b if a winding crown 119 is pulled outwardly by one step from a timepiece wear position shown in FIG. 5. If the winding crown 119 is pulled outwardly by one step from the timepiece wear position shown in FIG. 5, a winding stem 120 is also pulled outwardly to move the clutch wheel 124 inwardly through a prior art rear mechanism inclusive of a setting lever 121, clutch lever 122 and spring 123, thereby threadedly engaging the clutch wheel 124 with the minute gear 113b. The clutch wheel 124 is provided with a groove 124a with which is engaged a pin 127a secured to a minute hand control lever 127 pivotaly mounted on the substrate 101. About the pin 127a is loosely fitted a switch lever 128 which is pivotally mounted on and electrically connected to the substrate 101. The switch lever 128 is provided with a resilient member 128a which is provided at its center side near the free end thereof with the circuit block 103 projected therefrom. The switch lever 128 is also provided with a contact pin 130 electrically connected to the terminal $SW_1$ of the integrated circuit block 108.

Figure 6:
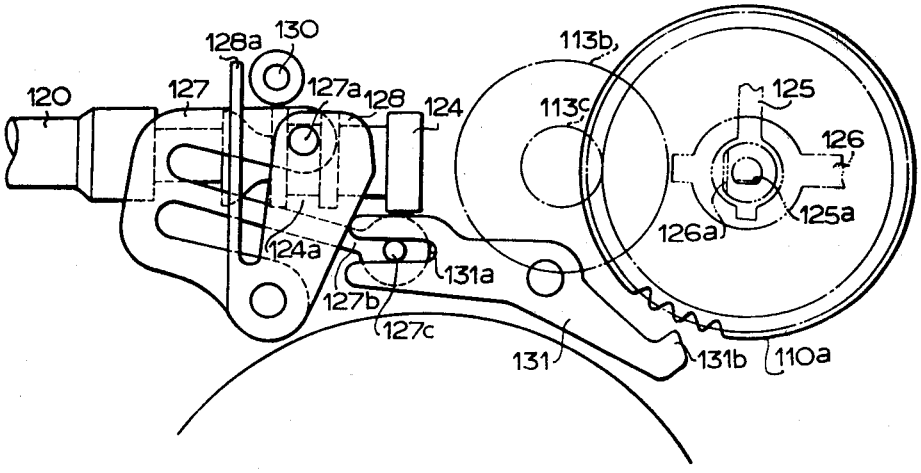
FIG. 6 is a plan view showing parts near a winding stem shown in FIG. 4.

The minute hand control lever 127 is provided with a resilient arm 127b from which is projected a pin 127c as shown in FIGS. 5 and 6. The pin 127c is engaged with a groove 131a formed in a forked arm of a minute hand control claw 131 pivotally mounted on the gear train support 102. The minute hand control pawl or claw 131 is also provided near the teeth of the second gear body 110a with a pawl or claw 131b.

The above described mechanical parts fitted in the electronic timepiece according to the invention will operate as follows.

If a set of 1 minute pulses are supplied from the integrated circuit block 108 to the coil 106 of the step motor, the rotor 107 is rotated for 120° by two steps.

This rotation causes the second gear body 110*a* through the reduction gear 109 to rotate for 6°. The rotation of the second gear body 110*a* is transmitted through the claw 110*e* secured to the second gear body 110*a* to the pitch determination gear 110*d* made integral with the second pinion 110*b* which is the minute hand shaft. The second pinion 10*b* acting through the minute gear 113 operates the cannon gear 114 at a rate of one rotation every 12 hours, as is well known in the art.

If the winding stem 120 is pulled by one step, the clutch gear 124 is moved toward the center of the timepiece and brought into engagement with the minute gear 113*b* as well known in the art. The minute gears 113*a* and 113*c* are threadedly engaged with the second pinion 110*b* and the cannon gear 114, respectively, and as a result, if the winding crown 119 is rotated, an hour hand 126 and a minute hand 125 are rotated, respectively.

If the clutch gear 124 is moved toward the center of the timepiece, the pin 127*a* engaged with the groove 124*a* of the clutch gear 124 is also moved in the same direction to rotate the minute hand control lever 127 and switch lever 128 in a clockwise direction in FIG. 6. As a result, a resilient arm 128*a* of the switch lever 128 becomes in contact with a contact pin 130 to turn ON the switch $SW_1$. In addition, the minute hand control claw 131 is rotated through the pin 127*c* projected from the resilient arm 127*b* of the minute hand control lever 127 in a counter clockwise direction in FIG. 6. The claw portion 131*b* of the minute hand control claw 131 is brought into contact with the second gear body 110*a* so as to prevent the rotation thereof and hence prevent the rotation of the rotor 107*a*, etc. Under such condition, if the winding crown 119 is rotated to effect the hand alignment, the flange 110*c* secured to the second pinion 110*b* slides along the second gear body 110*a*. In addition, a slip occurs between the claw 110*e* secured to the second gear body 110*a* and the step determination gear 110*d* secured to the second pinion 110*b*. But, the pitch determination gear 110*d* is provided with 60 teeth so that the claw 110*e* engages with either one tooth of these teeth in a stable state. As a result, the minute hand 125 secured to the second pinion 110*b* is always stopped at that position of the dial 116 which coincides with the minute marks on the dial 116, and hence it is possible to effect the hand alignment in an easy manner. Alternatively, the pitch determination gear 110*d* may be provided with teeth whose number is equal to 60 times an integer so as to stop the minute hand 125 at that position of the dial 116 which coincides with those marks on the dial 116 which are made smaller by a factor of integers than 1 minute.

If the winding crown 119 is pushed toward its normal position for wearing, the clutch gear 124 is returned to the position shown in FIG. 6. As a result, the switch lever 128 and the minute hand control claw 127 are also returned to the positions shown in FIGS. 5 and 6, respectively, to turn the switch $SW_1$ OFF and release the second gear body 110*a*. Thus, the hands 125, 126 are moved again in response to the rotation of the rotor 107*a*.

The timepiece substrate 101 is provided with a circular hole in which is arranged a battery 132 whose dial side is closed by a battery supporting metal fitting 133 which constitutes a (+) electrode and is connected through the substrate 101 to the ground. The battery 132 is closed at its rear cover side by a battery supporting metal fitting 134 secured by screws through insulating material to the substrate 101. The battery supporting metal fitting 134 is connected to a (−) electrode of the battery 132 and to a terminal $V_{SS}$ of the integrated circuit block 108 in the circuit block 103.

Between the circuit block 103 and the substrate 101 is arranged a crystal oscillator 135 which is electrically connected to terminals $\phi$out and $\phi$in of the integrated circuit block 108. Onto the upper surface of the circuit block 103 are secured a trimmer condenser 136 and a condenser 137. The trimmer condenser 136 is connected between the terminal $\phi$in of the integrated circuit 108 block and a terminal $V_{DD}$, while the condenser 137 is connected between the terminal $\phi$out and the terminal $V_{DD}$. The integrated circuit block 108 is provided on its upper surface with terminals $SW_2$ and $V_{DB}$ which are connected with each other by means of a metal pincette so as to constitute the exteriorly operable switch $SW_2$. The terminal $V_{DD}$ is electrically connected to the substrate 101.

What is claimed is:

1. An electronic timepiece having time measurement and time display functions, wherein time is electrically measured and visually displayed by mechanically moved indicators, said timepiece comprising:

an electromechanical transducer for converting electrical pulses into a mechanical force;

a reference oscillator for converting an electrically excited mechanical oscillation to a train of electrical pulses;

a frequency division circuit for dividing the frequency of said electrical pulses of said reference oscillator;

a driving circuit for receiving the output pulse from said frequency division circuit and applying driving pulses to said electromechanical transducer to produce said mechanical force;

a reduction gear train, driven by the force of said electromechanical transducer and driving said mechanically moved indicators;

a detection signal generation circuit for generating a detection signal wherein said detection signal is a repetition pulse with a frequency and pulse width to which said electromechanical transducer cannot respond to drive said reduction gear train; and means associated with said drive circuit for combining said driving pulses and said detection signal to transmit a combined signal to said electromechanical transducer wherein said driving pulse drives the transducer, while the detection signal generates a time measuring signal to which said transducer does not respond thereby permitting operational separation of said time measuring and time displaying functions.

2. The timepiece of claim 1, wherein said mchanical indicators are hands, and wherein the electromechanical transducer includes a coil and stator, wherein said stator is driven generated by said coil, when said coil is pulsed by said driving pulses.

3. An electronic timepiece, as claimed in claim 1, wherein said electromechanical transducer is a step motor, the output from said frequency division circuit is a train of pulses having an interval from 5 seconds to 2 minutes which drives said step motor; wherein said repetition pulse from said detecting signal generation circuit comprises pulses having an interval shorter than 1 second; wherein said reduction gear train comprises a rotor of said step motor, a pinion secured to said rotor, a minute hand pinion interlocked with said pinion, a minute hand gear wheel including said minute hand pinion, a minute gear wheel including a minute pinion directly engaged with said minute hand pinion, and a cannon gear wheel directly engaged with said minute pinion.

4. An electronic timepiece, as claimed in claim 3, wherein said driving circuit includes a phase inversion circuit and a phase control circuit, wherein a driving signal generation circuit is included, which delivers a signal to said phase inversion circuit and said phase control circuit, and wherein said detecting signal generation circuit delivers a signal to said phase control circuit only.

5. The electronic timepiece, as claimed in claim 4, further including: a detecting signal predominance circuit connected to said driving signal generation circuit, to said detection signal generation circuit and to said driving circuit, wherein said predominance circuit predominantly passes a predominance signal, when said repetition signal is superimposed on the driving pulse generated by said driving pulse generation circuit.

6. An electronic timepiece, as claimed in claim 3, wherein said frequency division circuit is operated under a negative trigger mode, wherein a logical sum circuit is used for adjusting the pulse width of the driving signal for driving said step motor, wherein each input terminal of said logical sum circuit is selectively supplied with the output pulses from said frequency division circuit, and wherein said output pulses are composed of the longest pulse of the output pulses used to make the wide driving pulse, and shorter pulses that are opposite in phase to an output pulse for driving following flip-flops.

7. An electronic timepiece, as claimed in claim 3, wherein said step motor is driven by alternate pulses, wherein the time interval between pulses of different polarities are smaller than the time interval between pulses of the same polarity, and hand of unit time of said time display means being moved by means of a set of alternate pulses.

8. An electronic timepiece, as claimed in claim 7, and further comprising a manually operable switch means for changing said driving pulse to a pulse having an interval longer than 0.2 second and supplying said pulse as an output to said step motor.

9. An electronic timepiece, as claimed in claim 3 wherein the timepiece is powered by battery means and further comprising: a reset means for delivering an output when a battery means is replaced by a new battery means and when a switch operation is effected, and a fast feed reset circuit operated by the output from said reset means for producing at least one pulse having a period shorter than 5 seconds to 2 minutes.

10. An electronic timepiece, as claimed in claim 3, further comprising an operating member disposed of said timepiece, a first switch operated by said exterior operating member; a battery; a second switch; a reset means for delivering an output when said battery is replaced by a new battery and when said second switch is operated; a memory circuit for memorizing said reset means and the output condition of said means and for delivering an output when said first switch is released; and a fast feed reset circuit operated by the output from said memory circuit and for producing at least one pulse having a period shorter than 5 seconds to 2 minutes so as to drive said step motor.

11. An electronic timepiece, as claimed in claim 3, and further comprising: a minute hand reset means operated to effect hand alignment when the winding crown is pulled out and including means interlocked with the winding crown for setting the minute hand to a positive minute and to minutes decreased by a factor of positive integers, and including a minute hand click means for discontinuously rotating said minute hand for 1 minute and minutes decreased by factor of positive integers.

12. An electronic timepiece, as claimed in claim 3, wherein between a second gear of a minute hand gear connected to the rotor of said step motor and a sliding gear positioned between the minute and said minute hand gear means are provided for effecting a hand alignment by the winding crown of the other hand and a pitch determination means which is increased by a factor of 60 integral steps is provided for said minute hand gear.

13. An electronic timepiece, as claimed in claim 3, further comprising: intermittently movable hands, a dial provided with graduations for indicating time according to the position of said hands; a hand shaft for defining a mounting position in the rotational direction of said hands and for supporting said hands; wherein each of said hands are loosely fitted around said hand shaft through two circular sections partly defined by chords to form a gap between the chords which permits a movement of more than one step of said intermittently movable hands and wherein the movement of said hands is coordinated with the graduations of said dial with respect to the position of the hand shaft in the rotational direction thereof with an adjustable allowance which corresponds to the size of said gap.

14. An electronic timepiece, as claimed in claim 3, further comprising: a count circuit which is supplied with an input signal from said frequency division circuit and delivers a minute output signal, a driving signal generation circuit supplied with said minute signal as an input, and an exteriorly operable minute hold switch for holding said driving signal generation circuit in phase with said step motor while operating said count circuit.

15. An electronic timepiece, as claimed in claim 3, further comprising: second count circuit supplied with a signal from said frequency division circuit as an input and for delivering a minute signal as an output, a second return to zero circuit for determining whether the content of said second count circuit is smaller than 30 or larger than 30 when the second return to zero operation is exteriorly effected and for delivering an output which clears said second count circuit even when said count of said second count circuit is smaller or larger than 30 so as to control the minute hand; a minute drive control circuit supplied through a logical sum circuit with said minute signal from said second count circuit and said second return to zero circuit; and and exteriorly operable minute hold switch for holding said minute drive control circuit in phase with said step motor while operating said second count circuit.

16. An electronic timepiece, as claimed in claim 3, further comprising: a switch operated by an exteriorly operable member to effect second return to zero operation, means for delivering a second return to zero pulse when said switch is operated and a driving pulse supplied to said driving circuit derived from the same pulse generation means.

17. An electronic timepiece, as claimed in claim 3; further comprising: an exteriorly operable member for effecting a hand correction without stopping the operation of said frequency division circuit; a switch interlocked with said exteriorly operable member for effecting hand correction and for controlling said driving circuit; and a timing adjustment circuit for adjusting timing of starting and completing said control effected by said switch.

18. An electronic timepiece, as claimed in claim 3, further comprising: a second count circuit; a second return to zero switch for clearing said second count circuit, and a light emitting diode and having driving means interlocked with said second return to zero switch, wherein said light emitting diode is ignited when said second return to zero switch is turned on so as to effect the second return to zero operation.

19. An electronic timepiece, as claimed in claim 1, wherein means are included for introducing a pulse determining repetition period for the detection signal from an intermediate stage of the frequency division circuit.

* * * * *

UNITED STATES PATENT AND TRADEMARK OFFICE

CERTIFICATE OF CORRECTION

PATENT NO. : 3,998,044

DATED : December 21, 1976

INVENTOR(S) : YAMAUCHI, ET AL.

It is certified that error appears in the above-identified patent and that said Letters Patent are hereby corrected as shown below.

Item 30, line 11, delete "48-14592[U]", insert -- 48-145921[U] --

Item 30, after last line, insert the following additional Foreign Application Priority Data:

-- July 1, 1974 Japan ..... 49-77591[U]
July 25, 1974 Japan ..... 49-88593[U]
July 25, 1974 Japan ..... 49-88597[U] --

Claim 10, line 2, after "disposed" insert -- exteriorly --

Claim 12, line 4, before "and" insert -- hand --

Claim 15, line 2, before "second" insert -- a --

Claim 15, line 14, delete "and" in the last instance and insert -- an -- therefor.

Signed and Sealed this

Nineteenth Day of April 1977

[SEAL]

*Attest:*

RUTH C. MASON
*Attesting Officer*

C. MARSHALL DANN
*Commissioner of Patents and Trademarks*